United States Patent [19]

Sheiko et al.

[11] 4,405,367

[45] Sep. 20, 1983

[54] CORROSION-RESISTANT CAST IRON

[75] Inventors: Anatoly A. Sheiko; Mikhail V. Voloschenko; Vladimir P. Latenko, all of Kiev; Gennady R. Kartashevsky, Kishenev; Evgeny I. Schegolkov; Anatoly D. Zlatkis, both of Moscow; Viktor G. Osokin, Moskovskaya; Lev V. Polyakov, Moscow; Valentin V. Zaitsev, Strasheny; Mikhail B. Trunov, Lipetskaya, all of U.S.S.R.

[73] Assignees: Institut Problem Litya Akademii Nauk Ukrainskoi SSR, Kiev; Otdelnoe Konstruktorskoe Bjuro Besshtangovykh Nassosov, Moscow, both of U.S.S.R.

[21] Appl. No.: 391,252

[22] Filed: Jun. 23, 1982

[51] Int. Cl.[3] ..... C22C 38/06

[52] U.S. Cl. ..... 75/124; 75/125

[58] Field of Search ..... 75/124 A, 123 CB, 125, 75/128 D, 124 E, 124 F

[56] References Cited

U.S. PATENT DOCUMENTS 3,909,252 9/1975 Kuriyama et al. ..... 75/123 CB

FOREIGN PATENT DOCUMENTS 434126 12/1974 U.S.S.R. ..... 75/125
451784 3/1975 U.S.S.R. ..... 75/124 A
724597 4/1980 U.S.S.R. ..... 75/125

*Primary Examiner*—E. Dewayne Rutledge
*Assistant Examiner*—Debbie Yee
*Attorney, Agent, or Firm*—Ladas & Parry

[57] ABSTRACT

A corrosion-resistant cast iron comprises (by mass %):

| | |
|---|---|
| carbon | 2.5 to 3.2 |
| silicon | 0.95 to 2.4 |
| manganese | 0.8 to 4.0 |
| nickel | 12.0 to 18.0 |
| chromium | 0.5 to 2.0 |
| copper | 4.0 to 8.0 |
| aluminium | 0.01 to 0.3 |
| magnesium | 0.005 to 0.07 |
| calcium | 0.01 to 0.10 |
| rare-earth metals | 0.001 to 0.08 |
| barium | 0.001 to 0.1 |
| tantalum | 0.003 to 0.02 |
| niobium | 0.005 to 0.3 |
| iron | balance |

4 Claims, No Drawings

CORROSION-RESISTANT CAST IRON

BACKGROUND OF THE INVENTION

1. Field of the Invention

The invention relates to corrosion-resistant cast iron and can be used in the metallurgy and foundry practice for the production of cast iron articles for use in chemical and petrochemical engineering.

It is common knowledge that segregation of main alloying components, which takes place during solidification of cast iron, results in a macroheterogeneous and microheterogeneous distribution of the alloying components. The segregation occurs even in the austenitic grain.

When such a cast iron is cooled down to a certain temperature depending on the macrodistribution and microdistribution of the alloying components the austenitic metal base partially dissociates to form martensite or bainite. The austenitic metal base dissociation causes a volume expansion of the cast iron, which in turn results in the increase of size of the resultant articles. This unwanted effect (formation of products of the austenite dissociation at the grain boundaries, and in the regions adjacent the graphite inclusions) affects to a great extent the corrosion resistance of the cast iron.

Therefore, apart from a high corrosion resistance, the corrosion-resistant cast iron should have a high resistance to its volume expansion. Hereinafter the term "expansion resistance" is used to mean a stability of the austenitic metal base, when the latter is subjected to a one-time or repeated cooling in the range of subzero temperatures, and the absence of phase transformations which lead to irreversible changes in the size of castings, and affect the corrosion resistance of the cast iron.

2. Prior Art

There is known a corrosion-resistant cast iron (USSR Author's Certificate No. 451,784) comprising, by mass %:

| | |
|---|---|
| carbon | 2.6 to 3.6 |
| manganese | 0.3 to 1.5 |
| copper | 0.5 to 9.0 |
| magnesium | 0.02 to 0.12 |
| yttrium | 0.01 to 0.10 |
| tin | 0.01 to 0.10 |
| silicon | 2.0 to 3.4 |
| nickel | 14 to 17 |
| chromium | 0.01 to 1.8 |
| calcium | 0.01 to 0.15 |
| rare-earth metals | 0.01 to 0.10 |
| aluminium | 0.005 to 0.3 |
| iron | balance |

Apart from high physical and mechanical properties this cast iron features resistance to corrosion when exposed to such corrosive media as ammonia liquor, sodium hydroxide, trisodium phosphate, perhydrol, calcium hydroxide, and also methanol, benzene, and carbon tetrachloride.

The prior art cast iron, however, shows a low corrosion resistance in petroleum saturated with hydrogen sulfide, and in the water having an elevated content of cations of iodine and bromine (iodine-bromide water).

Furthermore, said cast iron shows expansion resistance only at a temperature higher than −45° C., which limits its application in the chemical and petrochemical engineering.

SUMMARY OF THE INVENTION

An object of the present invention is to provide a corrosion-resistant cast iron which due to its high corrosion resistance and expansion resistance permits the field of its application in the chemical and petrochemical industries to be widened and the operating properties of the articles made therefrom to be improved.

The object of the invention is achieved by that a known in the art corrosion-resistant cast iron comprising carbon, silicon, manganese, nickel, chromium, copper, aluminium, magnesium, calcium, rare-earth metals, and iron, according to the invention further includes barium, tantalum, and niobium, with said cast iron ingredients taken in the following amounts, by mass %:

| | |
|---|---|
| carbon | 2.5 to 3.2 |
| silicon | 0.95 to 2.4 |
| manganese | 0.8 to 4.0 |
| nickel | 12.0 to 18.0 |
| chromium | 0.5 to 2.0 |
| copper | 4.0 to 8.0 |
| aluminium | 0.01 to 0.3 |
| magnesium | 0.005 to 0.07 |
| calcium | 0.01 to 0.10 |
| rare-earth metals | 0.001 to 0.08 |
| barium | 0.001 to 0.1 |
| tantalum | 0.003 to 0.02 |
| niobium | 0.005 to 0.3 |
| iron | balance |

The composition of the proposed cast iron provides for a high stability thereof in a petroleum saturated with hydrogen sulfide and in iodine-bromide water. The proposed corrosion-resistant cast iron features a resistance to expansion at temperatures below zero to −60° C., which permits the proposed corrosion-resistant cast iron to be widely used in chemical and petrochemical engineering, and the operating properties of the articles manufactured from this cast iron to be improved.

The presence of tantalum in the composition of the proposed cast iron in said amount makes it possible to raise the degree of dispersion of carbide inclusions and to thereby decrease microsegregation of alloying components which segregation affects corrosion resistance of the cast iron. The tantalum content in the cast iron is determined taking account of the following factors: if its content is higher than the recommended upper limit, the tantalum will favour solidification of the cast iron according to a metastable system, and in case said content is lower than the recommended lower limit, the tantalum will not have its effect at all.

The use of niobium in the composition of the proposed cast iron in said amount decreases segregation of nickel and copper in regions adjacent to the carbide inclusions, provides for a higher ductility of the cast iron, and favours cleaning of the grain boundaries from nitride inclusions.

The niobium content in the proposed cast iron depends on the rate of cooling and on the extent of its degassing because of its increased affinity for nitrogen. At elevated rates of cooling, with the niobium content being below the recommended lower limit, the niobium does not decrease segregation of nickel and copper. The upper limit of the niobium content in the cast iron is determined by the degree of degassing of a modified cast iron and by its influence on the mechanical properties of the cast iron at low rates of cooling the resultant casting.

Barium is an efficient modifying agent and at the same time an active graphitizing element in the modified cast iron. The cast iron modified by barium used in a recommended amount is less prone to chilling and overcooling.

It is recommended that the corrosion-resistant cast iron also include cobalt, with said cast iron ingredients taken in the following amounts, by mass %:

| | |
|---|---|
| carbon | 2.5 to 3.2 |
| silicon | 0.95 to 1.9 |
| manganese | 0.8 to 4.0 |
| nickel | 12.0 to 18.0 |
| chromium | 0.5 to 2.0 |
| copper | 4.0 to 8.0 |
| cobalt | 0.05 to 0.3 |
| aluminium | 0.01 to 0.3 |
| magnesium | 0.01 to 0.07 |
| calcium | 0.01 to 0.10 |
| rare-earth metals | 0.01 to 0.08 |
| barium | 0.001 to 0.10 |
| tantalum | 0.003 to 0.02 |
| niobium | 0.005 to 0.2 |
| iron | balance |

The presence of cobalt in the cast iron in said amounts decreases segregation of manganese and copper in the regions adjacent the grain boundaries, thereby favouring their more uniform distribution in the iron austenitic base, and decreasing the probability of the local austenite dissociation in the castings at low rates of cooling. This cast iron manifests a resistance to expansion at subzero temperature as low as −80° C.

It is expedient that the corrosion-resistant cast iron also include titanium, with said cast iron ingredients taken in the following amounts, by mass %:

| | |
|---|---|
| carbon | 2.5 to 3.2 |
| silicon | 0.95 to 2.4 |
| manganese | 0.8 to 4.0 |
| nickel | 12.0 to 18.0 |
| chromium | 0.5 to 2.0 |
| copper | 4.0 to 8.0 |
| aluminium | 0.01 to 0.3 |
| magnesium | 0.005 to 0.05 |
| calcium | 0.01 to 0.05 |
| rare-earth metals | 0.001 to 0.02 |
| barium | 0.001 to 0.1 |
| tantalum | 0.003 to 0.02 |
| niobium | 0.01 to 0.3 |
| cobalt | 0.05 to 0.3 |
| titanium | 0.05 to 0.5 |
| iron | balance |

Said corrosion-resistant cast iron features a high corrosion resistance in iodine-bromide water, petroleum saturated with hydrogen sulfide, expansion resistance at temperatures below zero to −80° C., and perfect casting properties.

DETAILED DESCRIPTION OF THE INVENTION

A corrosion-resistant cast iron of the invention was produced by alloying and modifying a melt of starting cast iron in a ladle with the use of various additions.

The starting cast iron is produced in electric furnaces. In this particular case the cast iron was smelted in an induction furnace. The smelting was carried out with the use of conventional charge materials, namely, nickel, cobalt, and a carburizing agent. After reaching a temperature of from 1530° to 1580° C., the melt thus produced is poured into a ladle containing a modifying agent preliminarily placed thereinto, said modifying agent containing magnesium, rare-earth metals, calcium, barium, and other elements. The quantity of the modifying agent is selected depending on the quality of the starting materials, cross-section of the castings to be produced and on the requirements placed thereupon. Pouring the cast iron melt was done at a temperature of from 1350° to 1450° C.

The cast iron thus produced was analyzed for chemical composition and tested for mechanical properties, corrosion resistance, and casting properties.

The samples for mechanical testing were cut from V-shaped pieces 370 mm long, 140 mm high, and which were 50 mm wide at the top and 30 mm wide at the bottom. The tests were conducted by conventional methods.

The samples both for corrosion tests in various corrosive liquids and for determining the microstructure of the cast iron, were cut from cast plates 10 mm thick, 50 mm wide, and 250 mm long.

The samples for corrosion test in the petroleum saturated with hydrogen sulfide after their having been degreased, dried and weighed were immersed in the petroleum through which was continuously passed hydrogen sulfide. The temperature of the petroleum was 100° C., and the test lasted 100 hours. After the completion of the test the samples were carefully cleaned from rust, washed, dried, and weighed. The rate of loss in material weight was determined by the loss in weight of the samples in a unit time related to a unit of the surface area.

The corrosion tests of the cast iron in other corrosive media were conducted in a similar way except for that said corrosive media had a room temperature. The duration of the corrosion test in iodine-bromide water was 500 hours including 120 hours for which said corrosive medium had a temperature of 80° C.±5° C.

The casting properties of the cast iron were determined by fluidity and by the volume of the contraction cavities and pores.

The fluidity of the cast iron in a liquid state was determined by that quartz pipes 3±0.1 mm in dia, having a negative pressure of 210±5 mm Hg, were filled with the cast iron being tested, whereafter the fluidity of said cast iron was determined by measuring the length of the pipe portion filled with the cast iron at various temperatures thereof.

The volume of the contraction cavities and pores was determined by applying conventional methods.

The invention will now be explained in greater detail with reference to embodiments thereof.

EXAMPLE 1

Corrosion-resistant cast iron of the invention was produced in the following manner.

First, a starting cast iron was produced in an induction furnace, which cast iron had the following composition (by mass %):

| | |
|---|---|
| carbon | 2.90 |
| silicon | 1.02 |
| manganese | 1.40 |
| nickel | 15.1 |
| copper | 7.5 |
| chromium | 1.30 |
| sulphur | 0.039 |
| phosphorus | 0.03 |
| aluminium | 0.10 |

-continued

| | |
|---|---|
| niobium | 0.11 |
| tantalum | 0.01 |
| iron | balance |

The starting cast iron of the above composition was then treated in a ladle at a temperature of 1500° C. by a modifying agent taken in an amount of 2% by weight of the melt.

The modifying agent was composed of the following elements, (by mass %):

| | |
|---|---|
| calcium | 8.6 |
| magnesium | 5.8 |
| aluminium | 1.7 |
| rare-earth metals | 5.3 |
| silicon | 46.0 |
| barium | 3.1 |
| iron | balance |

Pouring the cast iron thus produced was done at a temperature of 1350° C. The thus produced corrosion-resistant cast iron had the following composition (by mass %):

| | |
|---|---|
| carbon | 2.82 |
| silicon | 1.59 |
| manganese | 1.31 |
| nickel | 15.06 |
| copper | 7.5 |
| chromium | 1.31 |
| calcium | 0.06 |
| phosphorus | 0.03 |
| sulphur | 0.016 |
| aluminium | 0.12 |
| niobium | 0.11 |
| tantalum | 0.01 |
| barium | 0.04 |
| magnesium | 0.04 |
| rare-earth metals | 0.05 |
| iron | balance |

The resultant corrosion-resistant cast iron was analyzed for chemical composition, and tested for mechanical properties and corrosion resistance.

For the purpose of comparison there also was tested the prior art corrosion-resistant cast iron produced according to USSR Author's Certificate No 451,784, which had the following composition (by mass %):

| | |
|---|---|
| carbon | 2.62 |
| silicon | 3.37 |
| nickel | 16.81 |
| manganese | 0.3 |
| chromium | 1.74 |
| copper | 9.0 |
| aluminium | 0.26 |
| tin | 0.10 |
| calcium | 0.12 |
| magnesium | 0.06 |
| rare-earth metals | 0.03 |
| yttrium | 0.04 |
| iron | balance |

Table 1 below contains in a tabulated form the results of a microstructural analysis of the proposed corrosion-resistant cast iron and a corrosion-resistant cast iron produced in accordance with USSR Author's Certificate No 451,784.

TABLE 1

| Characteristics | Corrosion-resistant cast iron produced as described in Example 1 | Corrosion-resistant cast iron produced according to USSR Certificate No. 451,784 |
|---|---|---|
| Graphite | | |
| shape | globular | globular |
| quantity, % | 5 | 3 |
| Metal base | | |
| austenite, % | 88 | 77 |
| carbides, % | 7 | 20 |

As can be seen from Table 1, solidification of the cast iron, whose chemical composition corresponds to USSR Author's Certificate No 451,784, is accompanied by the formation of a considerable quantity of carbide inclusions.

Results of the tests for corrosion resistance in various corrosive media of the proposed corrosion-resistant cast iron and of the prior art corrosion-resistant cast iron produced in accordance with USSR Author's Certificate No 451,784, are given in a tabulated form in Table 2.

Iodine-bromide water used in the tests for corrosion resistance and given in the tables, contained 0.04 g/l of J, and 0.31 g/l of Br, with the total salt content being 176.5 g/l.

TABLE 2

| | | Rate of weight loss, g/m$^2$ per hour | |
|---|---|---|---|
| Medium | Concentration volume % | Corrosion-resistant cast iron produced as described in Example 1 | Corrosion-resistant cast iron produced according to USSR Author's Certificate No. 451,784 |
| 1 | 2 | 3 | 4 |
| Sulphuric acid | 75 | 0.069 | 0.081 |
| Sodium hydroxide | 40 | 0.0028 | 0.004 |
| Slaked lime | 20 | 0.0049 | 0.005 |
| Ammonia | 10 | 0.010 | 0.012 |
| Trisodium phosphate | 3 | 0.0101 | 0.020 |
| Perhydrol | — | 0.0143 | 0.023 |
| Methanol | — | 0.0108 | 0.015 |
| Benzene | — | 0.0098 | 0.011 |
| Carbon tetrachloride | — | 0.0095 | 0.015 |
| Iodine-bromide water | — | 0.0650 | 0.116 |
| Petroleum saturated with hydrogen sulfide | — | 0.0059 | 0.0645 |

Thus, as may be seen from the above table, the proposed corrosion-resistant cast iron has a higher corrosion resistance when exposed to corrosive media, and in particular to a petroleum saturated with hydrogen sulfide, and iodine-bromide water.

Table 3 shows in a tabulated form the results of the physical and mechanical tests to which were subjected both the proposed corrosion-resistant cast iron and the prior art corrosion-resistant cast iron produced in accordance with USSR Author's Certificate No 451,784.

TABLE 3

| Characteristics | Proposed cast iron produced as described in Example 1 | Prior art cast rion (USSR Author's Certificate No. 451,784) |
|---|---|---|
| Tensile strength, MPa | 425.3 | 402 |
| Elongation, % | 16 | 13 |
| Impact strength, J/cm$^2$ | 50 | 27.5 |
| Hardness, HB | 133 | 167 |

As will be seen from Table 3 the proposed corrosion-resistant cast iron features a higher strength and ductility.

EXAMPLE 2

A corrosion-resistant cast iron of the invention had the following composition (by mass %):

| | |
|---|---|
| carbon | 3.19 |
| silicon | 1.9 |
| nickel | 18.0 |
| manganese | 2.01 |
| chromium | 2.0 |
| copper | 8.0 |
| barium | 0.10 |
| niobium | 0.20 |
| tantalum | 0.02 |
| aluminium | 0.3 |
| calcium | 0.1 |
| magnesium | 0.07 |
| rare-earth metals | 0.08 |
| iron | balance |

The test results of the above corrosion-resistant cast iron are given below.

| | |
|---|---|
| The results of microstructural analysis: | |
| characteristics of the graphite | |
| shape | globular |
| quantity | 5% |
| characteristics of the metal base | |
| austenite | 87% |
| carbides | 8% |
| Corrosion resistance properties: | |
| (a) in a petroleum saturated with hydrogen sulfide; | |
| test duration, hrs | 100 |
| rate of weight loss, g/m$^2$ per hr | 0.0125 |
| depth of corrosion, mm per year | 0.0132 |
| (b) in iodine-bromide water: | |
| test duration, hrs | 500 |
| rate of weight loss, g/m$^2$ per hr | 0.0619 |
| depth of corrosion, mm per year | 0.0724 |
| Physical and mechanical properties: | |
| tensile strength, MPa | 441,5 |
| elongation, % | 10.0 |
| impact strength, J/cm$^2$ | 34.3 |
| hardness, HB | 165 |

EXAMPLE 3

A corrosion-resistant cast iron of the invention had the following composition (by mass %):

| | |
|---|---|
| carbon | 2.50 |
| silicon | 0.95 |
| nickel | 15.0 |
| manganese | 0.8 |
| chromium | 0.5 |
| copper | 4.0 |
| barium | 0.01 |

-continued

| | |
|---|---|
| niobium | 0.005 |
| tantalum | 0.003 |
| aluminium | 0.01 |
| calcium | 0.01 |
| magnesium | 0.01 |
| rare-earth metals | 0.01 |
| iron | balance |

The test results of the above corrosion-resistant cast iron are given below.

| | |
|---|---|
| The results of microstructural analysis: | |
| characteristics of the graphite: | |
| shape | globular |
| quantity | 7% |
| characteristics of the metal base: | |
| austenite, % | 88 |
| carbides, % | 5 |
| Corrosion-resistance properties: | |
| (a) in a petroleum saturated with hydrogen sulfide: | |
| test duration, hrs | 100 |
| rate of weight loss, g/m$^2$ per hr | 0.0069 |
| depth of corrosion, mm per year | 0.0081 |
| (b) in iodine-bromide water: | |
| test duration, hrs | 500 |
| rate of weight loss, g/m$^2$ per hr | 0.0746 |
| depth of corrosion, mm per year | 0.0872 |
| Physical and mechanical properties: | |
| tensile strength, MPa | 372.8 |
| elongation, % | 20 |
| impact strength, J/cm$^2$ | 54.9 |
| hardness, HB | 127 |

EXAMPLE 4

Corrosion-resistant cast iron of the invention had the following composition (by mass %):

| | |
|---|---|
| carbon | 2.8 |
| silicon | 1.5 |
| nickel | 16.2 |
| manganese | 1.4 |
| chromium | 1.2 |
| copper | 5.9 |
| barium | 0.05 |
| niobium | 0.1 |
| tantalum | 0.01 |
| aluminium | 0.15 |
| calcium | 0.04 |
| magnesium | 0.03 |
| rare-earth metals | 0.03 |
| cobalt | 0.14 |
| iron | balance |

The tests results of the above corrosion-resistant cast iron are given below.

| | |
|---|---|
| Microstructural analysis: | |
| characteristics the graphite | |
| shape | globular |
| quantity, % | 5 |
| characteristics of the metal base: | |
| austenite, % | 91 |
| carbides, % | 4 |
| Corrosion resistance properties: | |
| (a) in a petroleum saturated with hydrogen sulfide; | |
| test duration, hrs | 100 |
| rate of weight loss, g/m$^2$ per hr | 0.0046 |
| depth of corrosion, mm per year | 0.0054 |
| (b) in iodine-bromide water: | |
| test duration, hrs | 500 |

-continued

| | |
|---|---|
| rate of weight loss, g/m$^2$ per hr | 0.0280 |
| depth of corrosion, mm per year | 0.0336 |
| Physical and mechanical properties: | |
| tensile strength, MPa | 487.4 |
| elongation, % | 19.2 |
| impact strength, J/cm$^2$ | 55.0 |
| hardness, HB | 127.0 |

EXAMPLE 5

A corrosion-resistant cast iron of the invention had the following composition (by mass %):

| | |
|---|---|
| carbon | 2.8 |
| silicon | 1.5 |
| nickel | 16.2 |
| manganese | 1.4 |
| chromium | 1.2 |
| copper | 5.9 |
| barium | 0.02 |
| niobium | 0.1 |
| tantalum | 0.01 |
| aluminium | 0.15 |
| calcium | 0.02 |
| magnesium | 0.02 |
| rare-earth metals | 0.005 |
| cobalt | 0.12 |
| titanium | 0.17 |
| iron | balance |

The test results of the above corrosion-resistant cast iron are given below.

| | |
|---|---|
| Microstructural analysis: | |
| characteristics of the graphite: | |
| shape | vermicular |
| quantity, % | 8 |
| characteristics of the metal base | |
| austenite, % | 89 |
| carbides, % | 3 |
| Corrosion resistance properties: | |
| (a) in a petroleum saturated with hydrogen sulfide: | |
| test duration, hrs | 100 |
| rate of weight loss, g/m$^2$ per hr | 0.0054 |
| depth of corrosion, mm per year | 0.0063 |
| (b) in iodine-bromide water: | |
| test duration, hrs | 500 |
| rate of weight loss, g/m$^2$ per hr | 0.0374 |
| depth of corrosion, mm per year | 0.0437 |
| Physical and mechanical properties: | |
| tensile strength, MPa | 265.4 |
| elongation, % | 6 |
| impact strength, J/cm$^2$ | 21.5 |
| hardness, HB | 127 |
| Casting properties: | |
| fluidity at the casting temperature of 1350° C., mm | 320 |
| fluidity at the casting temperature of 1300° C., mm | 300 |
| fluidity at the casting temperature of 1200° C., mm | 270 |
| total volume of the contraction cavities and pores, % | 4.0 |
| shrinkage porosity | 1.6% |

While particular embodiments of the invention have been shown and described, various modifications thereof will be apparent to those skilled in the art and therefore it is not intended that the invention be limited to the disclosed embodiments or to the details thereof and the departures may be made therefrom within the spirit and scope of the invention as defined in the claims.

We claim:

1. Corrosion resistant cast iron consisting essentially of (by mass %):

| | |
|---|---|
| carbon | 2.5 to 3.2 |
| silicon | 0.95 to 2.4 |
| manganese | 0.8 to 4.0 |
| nickel | 12.0 to 18.0 |
| chromium | 0.5 to 2.0 |
| copper | 4.0 to 8.0 |
| aluminium | 0.001 to 0.3 |
| magnesium | 0.01 to 0.07 |
| calcium | 0.01 to 0.10 |
| rare-earth metals | 0.00. to 0.08 |
| barium | 0.01 to 0.1 |
| tantalum | 0.003 to 0.02 |
| niobium | 0.005 to 0.3 |
| cobalt | 0 to 0.3 |
| titanium | 0 to 0.5 |
| iron | balance |

2. Corrosion resistant cast iron as set forth in claim 1, consisting essentially of (by mass %):

| | |
|---|---|
| carbon | 2.5 to 3.19 |
| silicon | 0.95 to 1.9 |
| manganese | 0.8 to 2.01 |
| nickel | 15.0 to 18.0 |
| chromium | 0.5 to 2.0 |
| copper | 4.0 to 8.0 |
| aluminum | 0.01 to 0.3 |
| magnesium | 0.01 to 0.07 |
| calcium | 0.01 to 0.10 |
| rare-earth metals | 0.005 to 0.08 |
| barium | 0.01 to 0.1 |
| niobium | 0.005 to 0.2 |
| cobalt | 0 to 0.14 |
| titanium | 0 to 0.17 |
| iron | balance |

3. Corrosion resistant cast iron set forth in claim 2 wherein the following elements are present in the specified % by mass:

| | |
|---|---|
| titanium | 0.5 to 0.17 |
| cobalt | 0.5 to 0.14 |
| calcium | 0.01 to 0.05 |
| magnesium | 0.01 to 0.05 |

4. Corrosion resistant cast iron as set forth in claim 3 consisting essentially of (by mass %):

| | |
|---|---|
| carbon | 2.8 |
| silicon | 1.5 |
| manganese | 1.4 |
| nickel | 16:2 |
| copper | 5.9 |
| chromium | 1.2 |
| aluminum | 0.15 |
| niobium | 0.1 |
| tantalum | 0.01 |
| calcium | 0.02 |
| magnesium | 0.02 |
| rare-earth metals | 0.005 |
| barium | 0.02 |
| cobalt | 0.12 |
| titanium | 0.17 |
| iron | balance |

* * * * *